US011091982B2

(12) United States Patent
Williamson, Jr. et al.

(10) Patent No.: US 11,091,982 B2
(45) Date of Patent: Aug. 17, 2021

(54) EQUALIZING DEVICE

(71) Applicant: Halliburton Energy Services, Inc., Houston, TX (US)

(72) Inventors: Jimmie Robert Williamson, Jr., Carrollton, TX (US); Bharat Bajirao Pawar, Carrollton, TX (US); Shaun Wen Jie Ng, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/691,324

(22) Filed: Nov. 21, 2019

(65) Prior Publication Data

US 2020/0182014 A1 Jun. 11, 2020

(51) Int. Cl.
*E21B 34/10* (2006.01)

(52) U.S. Cl.
CPC ..... *E21B 34/101* (2013.01); *E21B 2200/05* (2020.05)

(58) Field of Classification Search
CPC ... E21B 2200/05; E21B 34/101; E21B 34/142
See application file for complete search history.

(56) References Cited

U.S. PATENT DOCUMENTS 3,332,497 A * 7/1967 Page, Jr. ..... E21B 34/08 166/329
4,103,744 A * 8/1978 Akkerman ..... E21B 34/101 166/324
4,415,036 A 11/1983 Carmody et al.
4,452,311 A * 6/1984 Speegle ..... E21B 34/105 166/324
4,478,286 A 10/1984 Fineberg
5,752,569 A * 5/1998 Bhavsar ..... E21B 34/101 166/324
6,079,497 A 6/2000 Johnston et al.
6,237,693 B1 * 5/2001 Deaton ..... E21B 34/101 166/375
6,283,217 B1 9/2001 Deaton
6,296,061 B1 10/2001 Leismer
2014/0231092 A1 * 8/2014 Mock ..... E21B 34/04 166/363

* cited by examiner

*Primary Examiner* — James G Sayre

(74) *Attorney, Agent, or Firm* — Scott Richardson; Parker Justiss, P.C.

(57) ABSTRACT

Embodiments of an equalizing device for use with a safety valve and a safety valve are provided herein. In one embodiment, the equalizing device includes at least a tubular having a central bore extending axially there through, the tubular having a ball seat. The equalizing device may further include a ball positioned proximate the ball seat, the ball configured to move from a first position engaged with the ball seat to a second position disengaged from the ball seat to equalize pressure across the safety valve, and an arced ring positioned radially outside the ball, the arced ring configured to keep the ball engaged with the ball seat when in the first position and maintain the ball radially outside the ball seat when in the second position.

21 Claims, 7 Drawing Sheets

EQUALIZING DEVICE

CROSS-REFERENCE TO RELATED APPLICATION

This application claims priority to International Application Serial No. PCT/US2018/064307, filed on Dec. 6, 2018, and entitled "EQUALIZING DEVICE," is commonly assigned with this application and incorporated herein by reference in its entirety.

TECHNICAL FIELD

This application is directed, in general, to a safety valve and, more specifically, to an equalizing device for use with a safety valve, and a method of operating an equalizing device.

BACKGROUND

Operations performed and equipment utilized in conjunction with a subterranean production well usually require a safety valve be set relatively deep in the production well to circumvent potential production mishaps that can occur with the producing well. For example, a safety valve may be set at a depth of 1,000 feet or more.

Most offshore hydrocarbon producing wells are required by law to include a safety valve, such as a surface-controlled subsurface safety valve (SCSSV), located downhole in the production string to shut off the flow of hydrocarbons in an emergency. These safety valves are usually set below the mudline in offshore wells. Before the safety valve can be opened, pressure should be equalized across the valve. Certain safety valves, and some SCSSVs, may have a smaller outside diameter and as such may have space limitations. Accordingly, traditional equalizing devices may not fit in certain safety valve configurations. What is needed is an equalizing device that may be used in safety valve configurations having smaller outer diameters.

BRIEF DESCRIPTION

Reference is now made to the following descriptions taken in conjunction with the accompanying drawings, in which.

DETAILED DESCRIPTION

Figure 1:
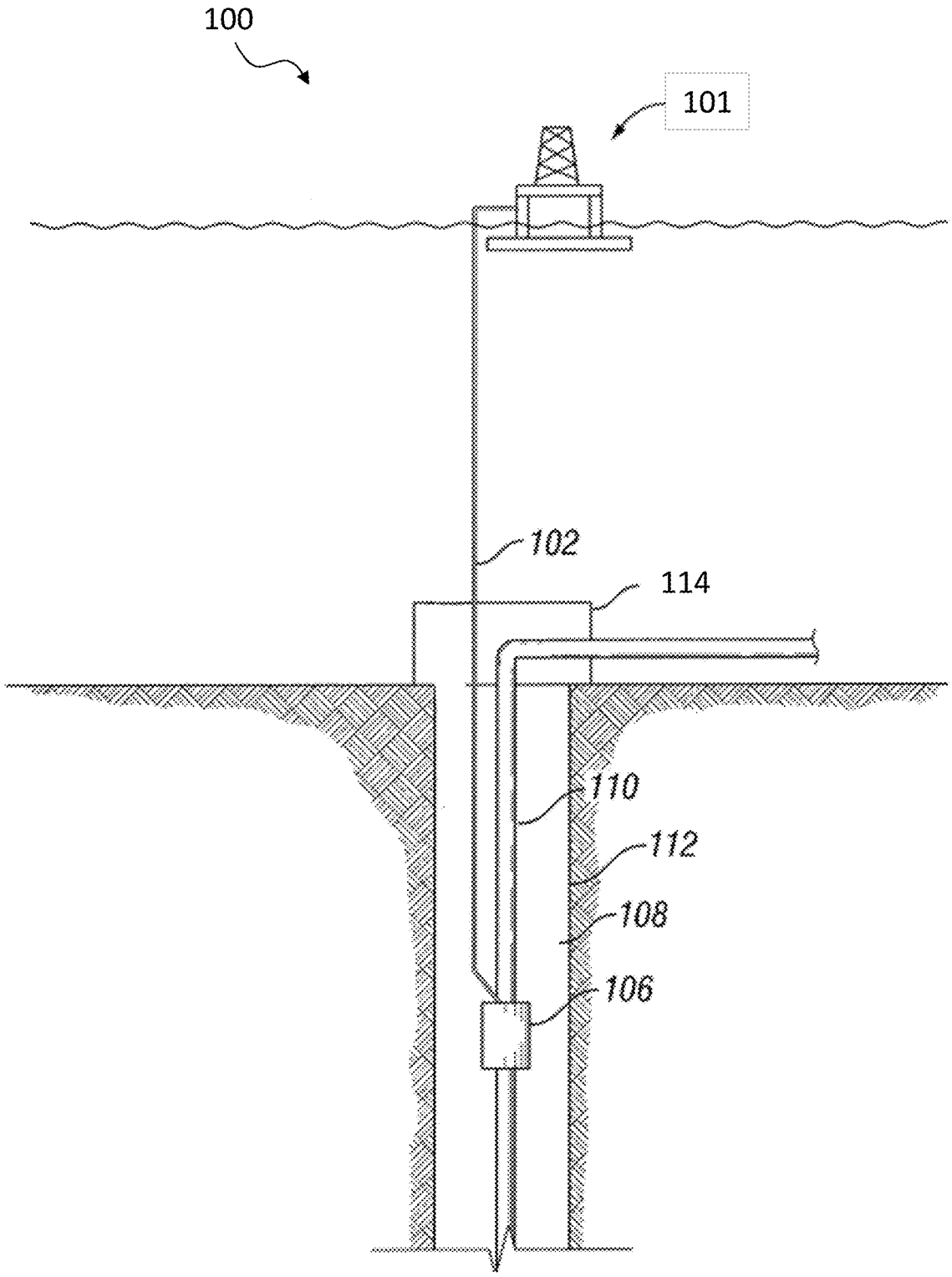
FIG. 1 illustrates a subterranean production well employing an subsurface safety valve having an equalizing device constructed according to the principles of the present disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the formation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

The description and drawings included herein merely illustrate the principles of the disclosure. It will thus be appreciated that those skilled in the art will be able to devise various arrangements that, although not explicitly described or shown herein, embody the principles of the disclosure and are included within its scope.

FIG. 1 illustrates a subterranean production well 100, including an offshore platform 101 connected to a safety valve 106, such as an SCSSV, via fluid/electrical connection 102. An annulus 108 may be defined between walls of wellbore 112 and a conduit 110. Wellhead 114 may provide a means to hand off and seal conduit 110 against wellbore 112 and provide a profile to latch a subsea blowout preventer to. Conduit 110 may be coupled to wellhead 114. Conduit 110 may be any conduit such as a casing, liner, production tubing, or other tubulars disposed in a wellbore.

The safety valve 106 may be interconnected in conduit 110 and positioned in wellbore 112. Although the wellbore 112 is depicted in FIG. 1 as an offshore well, one of ordinary skill should be able to adopt the teachings herein to any type of well including onshore or offshore. The fluid/electrical connection 102 may extend into the wellbore 112 and may be connected to the safety valve 106. The fluid/electrical connection 102 may provide actuation and/or de-actuation of the safety valve 106. Actuation may comprise opening the safety valve 106 to provide a flow path for wellbore fluids to enter conduit 110, and de-actuation may comprise closing the safety valve 106 to close a flow path for wellbore fluids to enter conduit 110.

Figure 2:
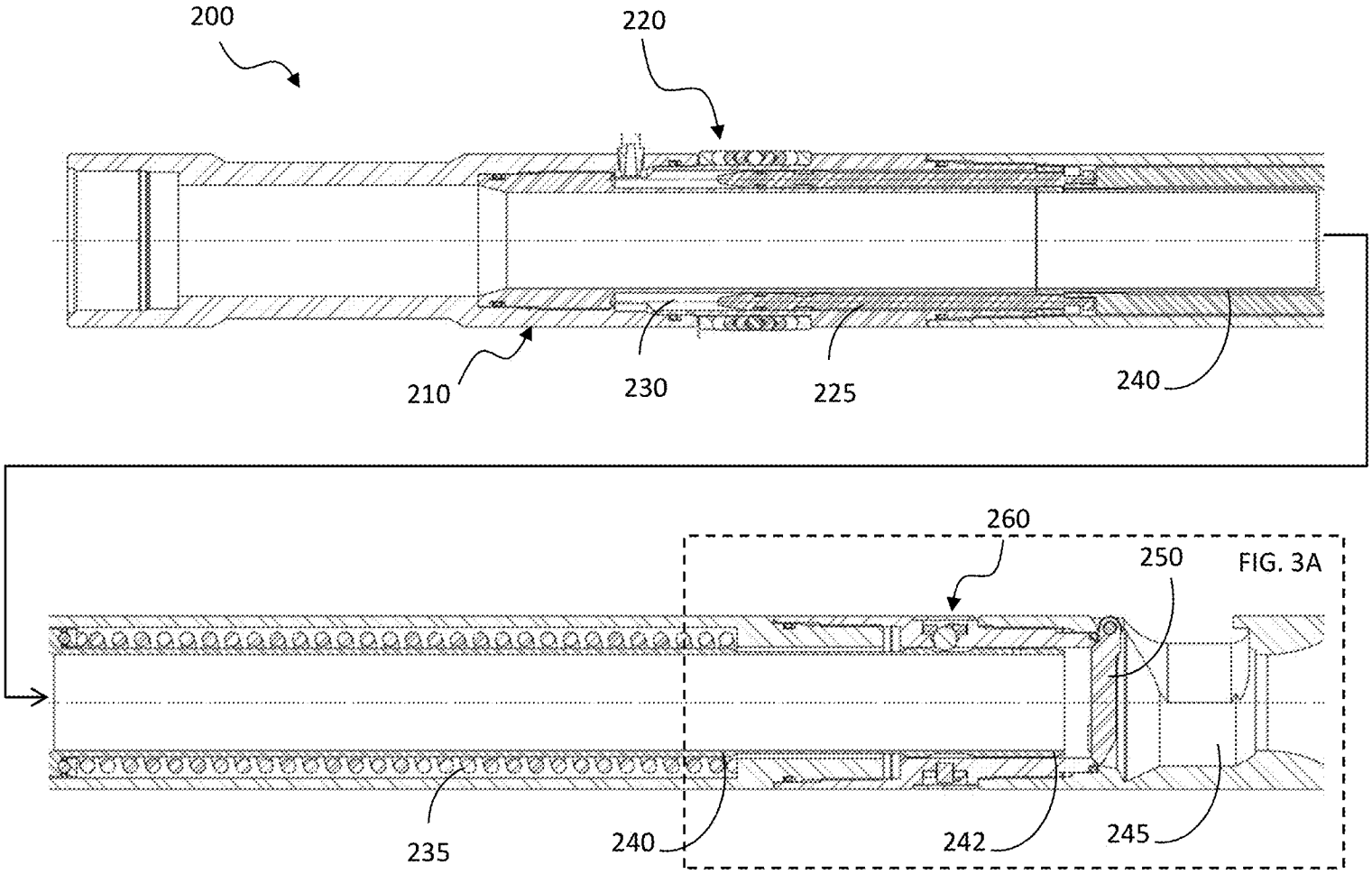
FIG. 2 illustrates a safety valve having one embodiment of an equalizing device according to the principles of the present disclosure, as may be employed in FIG. 1.

Referring to FIG. 2, a safety valve 200 manufactured according to the disclosure is shown. While the safety valve 200 is illustrated as an SCSSV, those skilled in the art understand that it could be configured as a different safety valve and remain within the purview of the disclosure. The safety valve 200 illustrated in FIG. 2 includes a housing 210 having a tubular, such as flow tube 240 positioned axially therein. Associated with the housing 210 (e.g., located in the housing 210 in one embodiment) is an actuator 220 that is configured to move the safety valve 200 between a closed state and an open state. The actuator 220, in the illustrated embodiment, includes one or more pistons 225 positioned within a fluid chamber 230. The one or more pistons 225 are attached to the flow tube 240 (e.g., either directly or through one or more sliding sleeves), and thus as the volume of the fluid chamber 230 changes, the flow tube 240 moves between opened and closed positions. In the embodiment of FIG. 2, a spring 235 is positioned between a shoulder in the housing 210 and an uphole end of the flow tuber 240. In the embodiment of FIG. 2, the spring 235 is fully extended, thus the flow tube 240 is fully retracted, resulting in the safety valve 200 being in a closed position.

The safety valve 200 may be disposed in a wellbore as part of a wellbore completion string. The wellbore may penetrate an oil and gas bearing subterranean formation such that oil and gas within the subterranean formation may be produced. A region 245 directly below the safety valve 200 may be exposed to formation fluids and pressure by being in fluid communication with fluids present in the wellbore. Region 245 may be part of a production tubing string disposed of in the wellbore, for example. A valve closure mechanism 250 positioned proximate a distal end 242 of the flow tube 240 may isolate region 245 from the flow tube 240, which may prevent formation fluids and pressure from flowing into flow tube 240 and thus uphole toward the surface, when valve closure mechanism 250 is in a closed state. Valve closure mechanism 250 may be any type of valve, such as a flapper type valve or a ball type valve, among others. FIG. 2 illustrates the valve closure mechanism 250 as being a flapper type valve. As will be illustrated in further detail below, the valve closure mechanism 250 may be actuated into an open state to allow formation fluids to flow from region 245 through a flow path within flow tube 240, whereafter it may travel uphole to the surface.

When the safety valve 200 is in the first closed state, differential pressure across valve closure mechanism 250 will prevent wellbore fluids from flowing from region 245 into flow tube 240. In order to move the valve closure mechanism 250 into an open state, the pressure across the valve closure mechanism 250 should be substantially equalized. Equalizing device 260 may be used to equalize the pressure across both sides of the valve closure mechanism 250. Certain small wellbore applications limit the amount of space allotted for the equalizing device 260. For instance, traditional equalizing devices may not necessarily work in such small wellbore applications. When, for example, the outside diameter of housing 210 may be smaller than about 3.75 inches, traditional equalizing devices may not fit given the size and spacing constraints. Notwithstanding the foregoing, an equalization device according to the disclosure is not limited only to small wellbore applications.

Figure 3B:
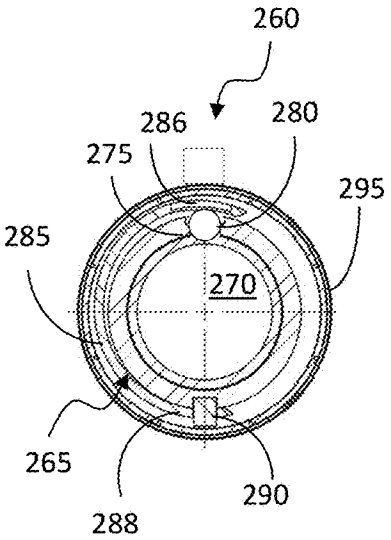
FIG. 3B is a cross-section view of the equalizing device shown in FIG. 3A.
Figure 3A:
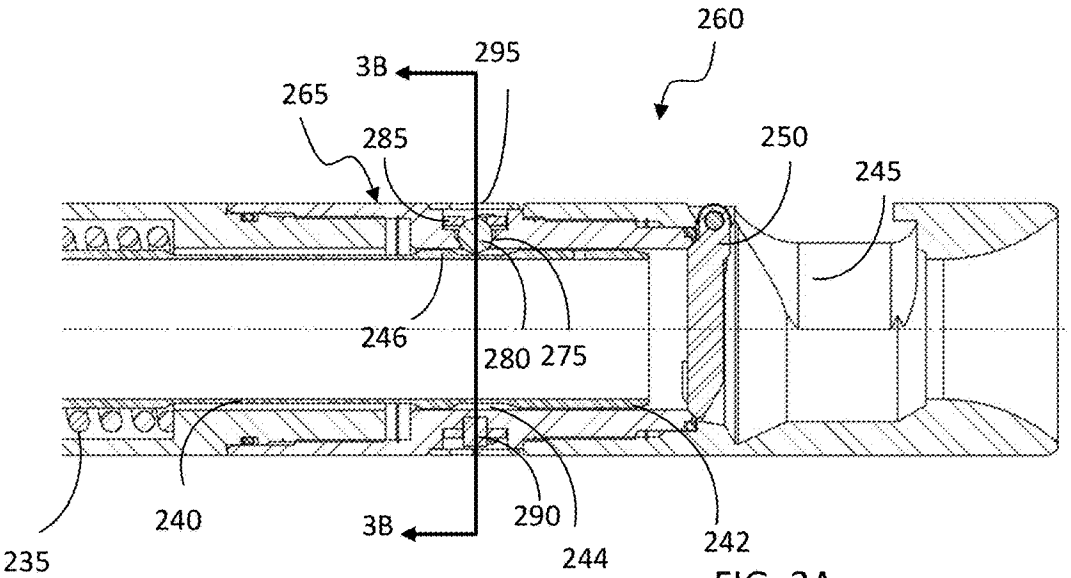
FIG. 3A is a section view of the equalizing device shown in FIG. 2 at a first operational state according to the principles of the present disclosure.

Referring now to FIG. 3A-3B, there is shown a side section view and a cross-section view, respectively, of an equalizing device 260 that may work in small wellbore applications. Equalizing device 260 may be positioned proximate and radially outside the distal end 242 of the flow tube 240 in the retracted state. Equalizing device 260 may include a tubular 265 having a central bore 270 extending axially there through. The tubular 265, in one embodiment, may further include a ball seat 275, which provides fluid access between an outer surface of the tubular 265 and the central bore 270. In the illustrated embodiment, a ball 280 is positioned proximate the ball seat 275. Ball 280 is shown in FIG. 3A-3B in a first position, engaged with the ball seat 275, which may be when the valve closure mechanism 250 is in a closed position. The ball 280 is configured to move from the first position engaged with the ball seat 275 to a second position disengaged from the ball seat 275 to equalize pressure across the safety valve 200.

As illustrated in the embodiment of FIG. 3A, the flow tube 240 includes a slot 244 near the distal end 242 thereof. When the slot 244 is positioned below the ball 280, the ball 280 remains within a first position seated within the ball seat 275, and thus no fluid communication exist between the outer surface of the tubular 265 and the central bore 270. In the embodiment of FIG. 3A, to equalize pressure across the valve closure mechanism 250, the actuator 220 moves the flow tube 240 downhole toward the valve closure mechanism 250. As the flow tube 240 moves downhole, a ramp 246 at an uphole end of slot 244 engages the ball 280 and pushes the ball 280 radially outward, "up" and out of engagement with the ball seat 275 into a second position. This will be shown in more detail in FIG. 4A-4B.

Positioned radially outside the ball 280 may be an arced ring 285. The arced ring 285, in this embodiment, is configured to keep the ball 280 engaged with the ball seat 275. The arced ring 285 may include a first end 286 located proximate the ball 280 and a second end 288 coupled with the tubular 265. At the second end 288 of the arced ring 285, there may be a pin 290 or other similar device configured to maintain the position of the arced ring 285 relative to the ball 280.

In some embodiments, an outer housing 295 may be positioned to substantially surround the arced ring 285. The outer housing 295 may be a ported retainer ring, and in some embodiments, may include one or more filters to filter particulates that may be present in the wellbore from flowing through the tubular 265.

Figure 3C:
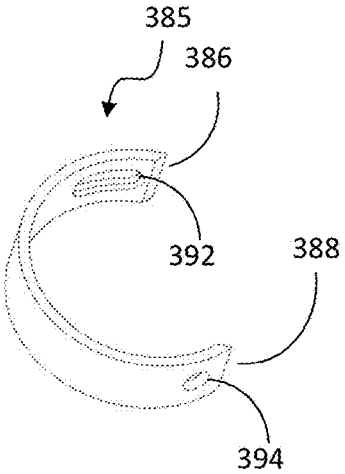
FIG. 3C is a perspective view of one feature of the equalizing device of FIGS. 3A and 3B.

Referring to FIG. 3C, illustrated is one embodiment of an arced ring 385 that may be used within the equalizing device 260. The arced ring 385, in the embodiment shown, is a c-spring. The arced ring 385, in this embodiment, may have at a first end 386 having a chamfered opening 392 configured to engage the ball 280. In some embodiments, a second end 388 may include an opening 394 for receiving a pin, such as pin 290 therethrough. The pin 290 holds the arced ring 385 such that the chamfered opening 392 remains over and engaged with the ball 280. In some embodiments, the ball 280 may be able to tolerate a pressure range between about 10 k psi to about 15 k psi, and in some embodiments, the arced ring 385 may be configured to exert a spring force of between about 0.174 psi and about 80 psi. While the arced ring 385 may have a varying spring radius, in some embodiments, the arced ring 385 may have a spring radius greater than 180 degrees, and in certain other embodiments about 270 degrees or more.

Figure 4A:
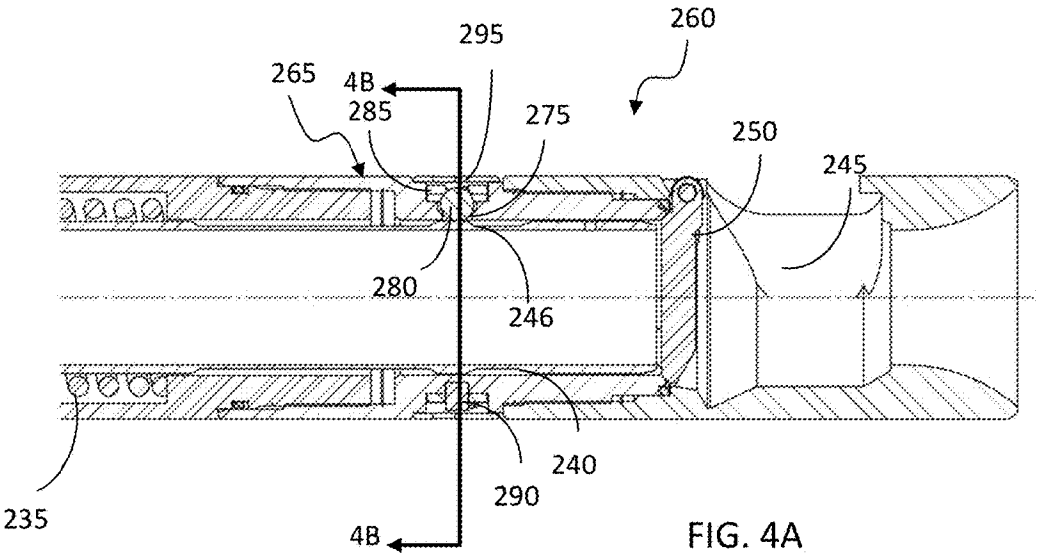
FIG. 4A is a section view of the equalizing device shown in FIG. 2 at a second operational state according to the principles of the present disclosure.
Figure 4B:
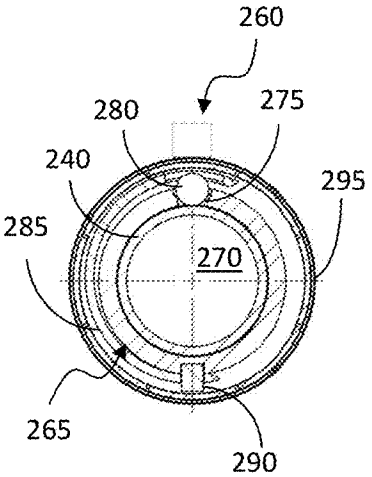
FIG. 4B is a cross-section view of the equalizing device shown in FIG. 4A.

Referring now to FIG. 4A-4B, there is shown a side section view and a cross-section view of the equalizing device 260 as the flow tube 240 continues to move downhole, resulting with the ball 280 in a second position. As is illustrated, when the flow tube 240 moves downhole toward valve closure mechanism 250, ramp 246 engages the ball 280, causing the ball to move "up," radially outward, and out of engagement with the ball seat 275. This allows wellbore fluids to flow through the equalizing device 260 to substantially equalize pressure across the valve closure mechanism 250, such that it can then move into an open position when contacted by the flow tube 240.

Figure 5A:
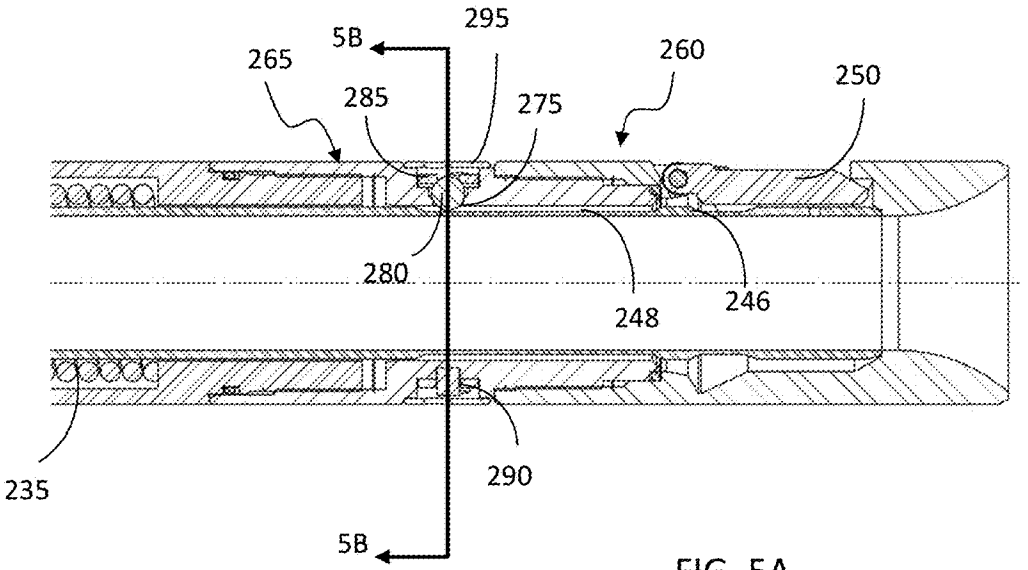
FIG. 5A is a section view of the equalizing device shown in FIG. 2 at a third operational state according to the principles of the present disclosure.
Figure 5B:
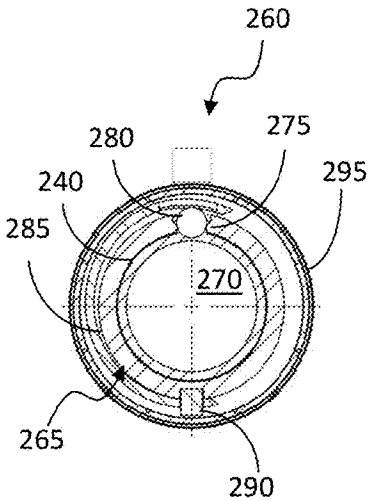
FIG. 5B is a cross-section view of the equalizing device shown in FIG. 5A.

Referring now to FIGS. 5A and 5B, there is shown a side section view and a cross-section view of the equalizing device 260 as the flow tube 240 continues to move downhole, thereby pushing the valve closure mechanism 250 into an open state such that fluids may flow from the region 245 through the flow tube 240 uphole to the surface. The ball 280, in this embodiment, is thus allowed to move into a third position, wherein the ball 280 has re-engaged with the ball seat 275. Accordingly, at this stage the equalizing device 260 is closed. As is illustrated, the flow tube 240 may include at least a second slot 248, such that as the flow tube 240 moves downhole relative to the ball 280 and the valve closure mechanism 250 opens, the ball 280 is able to move radially inward and re-engage with the ball seat 275.

Various features and components of the embodiments of equalizing device 260 disclosed herein may be constructed of different materials capable of withstanding fluids and materials which may be present within the wellbore. In one embodiment, the ramp 246 at the distal end 242 of flow tube 240 may be constructed of and/or coated with various materials such that the ramp 246 has a strength of at least greater than about 40 HRC, and in some embodiments, a strength of about 80 HRC or greater. In one embodiment, the ramp 246 is hardened with tungsten carbide, such that the surface of the ramp 246 is hard enough to lift the ball 280.

Figure 6B:
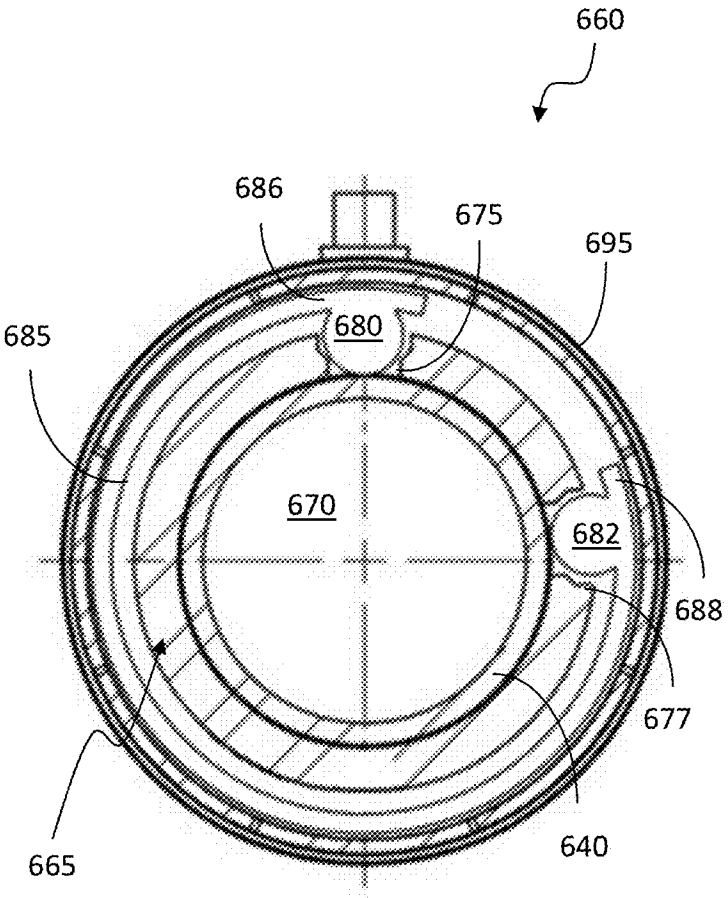
FIG. 6B is a cross-section view of the equalizing device of FIG. 6A shown in a second operational state according to the principles of the present disclosure.
Figure 6A:
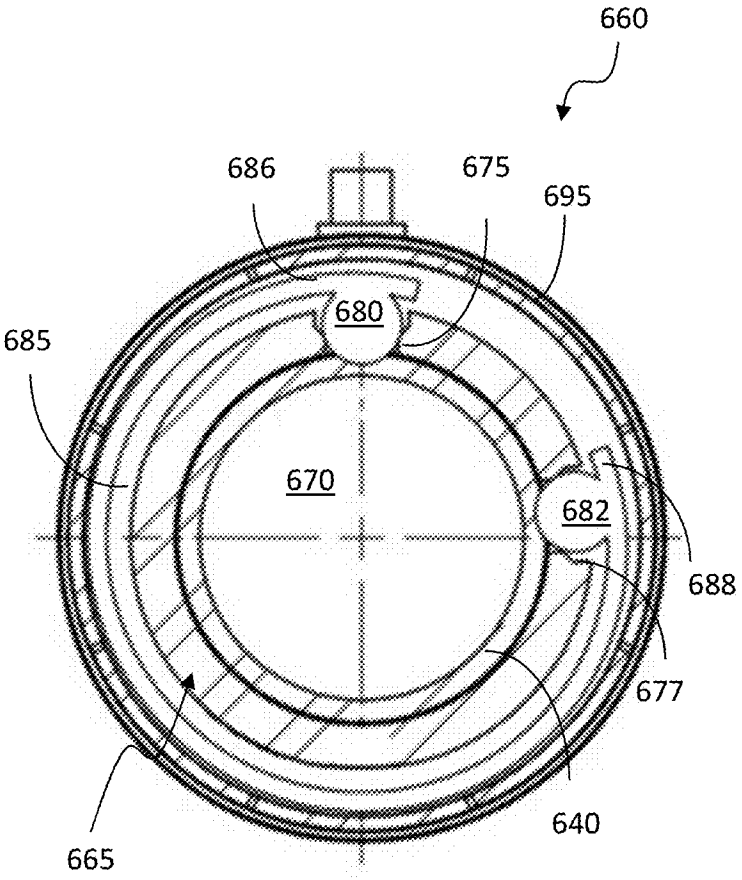
FIG. 6A is a cross-section view of another embodiment of an equalizing device shown in a first operational state according to the principles of the present disclosure.

Referring now to FIG. 6A-6B, there is shown a cross-sectional view of another embodiment of an equalizing device 660 according to the disclosure. The equalizing device 660 includes at least a tubular 665 having a central bore 670 running axially there through, and a first ball seat 675. A first ball 680 is positioned proximate the first ball seat 675. Positioned radially outside of the first ball 680 is an arced ring 685. The arced ring 685, in this embodiment, has a first end 686 and a second end 688. In this embodiment, the first ball 680 is integrally formed with the first end 686, and the second ball 682 is integrally formed with the second end 688. The tubular 665 may include a second ball seat 677 as shown, but there may be embodiments where there may only be one ball seat. In this embodiment, an outer housing 695, which may be a ported retainer ring and in some embodiments may include one or more filters, surrounds the tubular 665.

First ball 680 and second ball 682 are shown in FIG. 6A in a first position, wherein first ball 680 and second ball 682 are positioned over a slot (not shown) in a distal end of a flow tube 640, such that first ball 680 and second ball 682 are seated in the first ball seat 675 and the second ball seat 677, respectively. First ball 680 and second ball 682 are shown in FIG. 6B in a second position, wherein first ball 680 and second ball 682 are positioned over a ramp (not shown) in a distal end of a flow tube 640, such that first ball 680 and second ball 682 are disengaged from the first ball seat 675 and the second ball seat 677, respectively.

Figure 7B:
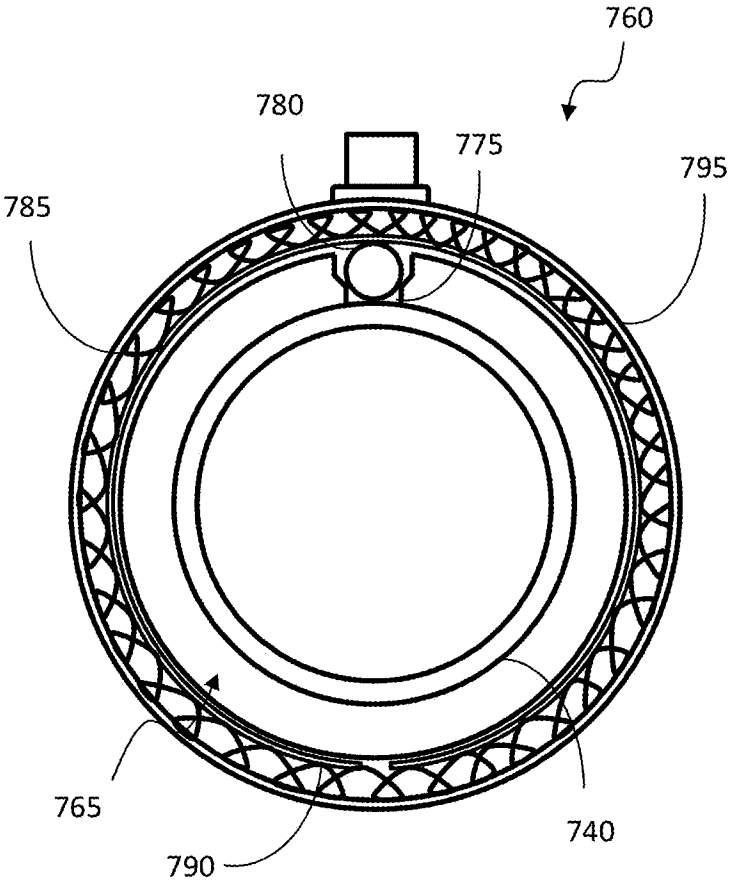
FIG. 7B is a cross-section view of the equalizing device of FIG. 7A shown in a second operational state according to the principles of the present disclosure.
Figure 7A:
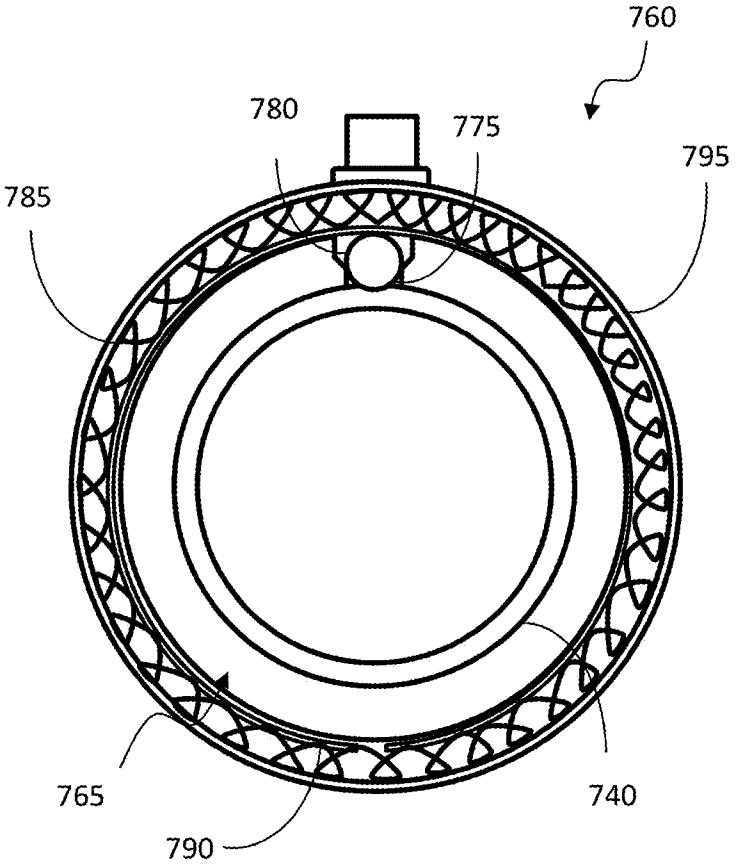
FIG. 7A is a cross-section view of yet another embodiment of an equalizing device shown in a first operational state according to the principles of the present disclosure.
Figure 7C:
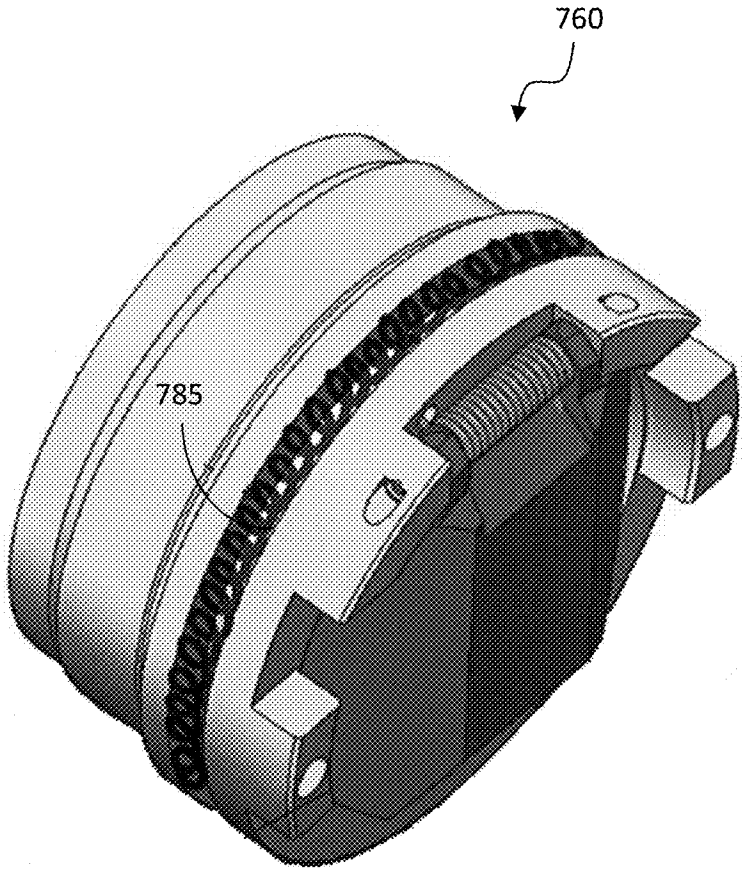
FIG. 7C is a perspective view of the equalizing device of FIGS. 7A and 7B.

Referring now to FIG. 7A-7B, there is shown a cross-sectional view of another embodiment of an equalizing device 760 according to the disclosure. The equalizing device 760 includes at least a tubular 765 having a ball seat 775. A ball 780 is positioned proximate the ball seat 775. Positioned radially outside of the ball 780 is a spring 785, such as a garter spring, and an outer housing 795. The spring 785 exerts a radial force on the ball 780, both in a first position shown in FIG. 7A, wherein ball 780 is positioned over a slot (not shown) in a distal end of a flow tube 740 and thus seated in the ball seat 775, and also in a second position shown in FIG. 7B, wherein ball 780 is positioned over a ramp (not shown) in a distal end of a flow tube 740 and thus disengaged from the ball seat 775. In certain embodiments, a retaining ring 790, such as an arced ring or a c-ring, is positioned between the ball 780 and the spring 785. The retaining ring 790, in this embodiment, is configured to keep the ball 780 from rotating away from the general region of the ball seat 775. Turning briefly to FIG. 7C, illustrated is a perspective view of the equalizing device 760. As is shown in this view, the spring 785 may be positioned within a cutaway seat in the tubular 765. This embodiment of the equalizing device 760 may be used in traditional safety valve configurations of all sizes and also in safety valve configurations having a smaller outside diameter, wherein the outside diameter of the safety valve is less than about 3.75 in.

Aspects disclosed herein include:

A. An equalizing device for use with a safety valve, comprising: a tubular having a central bore extending axially there through, the tubular having a ball seat; a ball positioned proximate the ball seat, the ball configured to move from a first position engaged with the ball seat to a second position disengaged from the ball seat to equalize pressure across a safety valve; and an arced ring positioned radially outside the ball, the arced ring configured to keep the ball engaged with the ball seat when in the first position and maintain the ball radially outside the ball seat when in the second position.

B. A safety valve for use within a wellbore, comprising: a housing; a flow tube extending axially through the housing, the flow tube configured to convey subsurface production fluids there through; a valve closure mechanism disposed proximate a downhole end of the flow tube; an equalizing device configured to equalize pressure across the valve closure mechanism, the equalizing device proximate to the valve closure mechanism, the equalizing device including: a tubular having a central bore extending axially there through, the tubular having a ball seat; a ball positioned proximate the ball seat, the ball configured to move from a first position engaged with the ball seat to a second position disengaged from the ball seat to equalize pressure across the safety valve; and an arced ring positioned radially outside the ball, the arced ring configured to keep the ball engaged with the ball seat when in the first position and maintain the ball radially outside the ball seat when in the second position; and an actuator associated with the housing, the actuator configured to axially slide the flow tube to move the valve closure mechanism between a closed state and an open state after the equalizing device has equalized the pressure.

C. A method for equalizing pressure across a valve closure mechanism of a safety valve, the method comprising: placing a safety valve within a wellbore, the safety valve including; a housing; a flow tube extending axially through the housing, the flow tube having a ramp member on an outer surface thereof and configured to convey subsurface production fluids there through; a valve closure mechanism disposed proximate a downhole end of the flow tube; an equalizing device configured to equalize pressure across the valve closure mechanism, the equalizing device proximate to the valve closure mechanism, the equalizing device including: a tubular having a central bore extending axially there through, the tubular having a ball seat; a ball positioned proximate the ball seat, the ball configured to move from a first position engaged with the ball seat to a second position disengaged from the ball seat to equalize pressure across the safety valve; and an arced ring positioned radially outside the ball, the arced ring configured to keep the ball engaged with the ball seat when in the first position and maintain the ball radially outside the ball seat when in the second position; and an actuator associated with the housing and coupled to the flow tube; and powering the actuator to axially move the flow tube along the tubular, such that the ramp member moves the ball from the first position to the second position to substantially equalize pressure across the valve closure mechanism.

Aspects A, B, and C may have one or more of the following additional elements in combination:

Element 1: further including an outer housing substantially surrounding the arced ring;

Element 2: wherein the outer housing is a ported retainer ring;

Element 3: wherein the ported retainer ring includes one or more fluid filters;

Element 4: wherein the arced ring has a first end located proximate the ball, and a second end physically attached to an outer surface of the tubular;

Element 5: wherein the first end of the arced ring includes chamfers for engaging the ball, and wherein the second end of the arced ring is physically attached to the outer surface of the tubular by a pin;

Element 6: wherein the ball integrally forms part of a first end of the arced ring;

Element 7: wherein the ball is a first ball and the arced ring further includes a second ball that integrally forms a part of a second end of the arced ring;

Element 8: further comprising a garter compression spring positioned radially about the arced ring; and Element 9: further including a ramp member positioned radially inside of the ball, the ramp member configured to move the ball from the first position to the second position as the ramp member moves axially along the tubular.

Those skilled in the art to which this application relates will appreciate that other and further additions, deletions, substitutions and modifications may be made to the described embodiments.

What is claimed is:

1. An equalizing device for use with a safety valve, comprising:

a tubular having a central bore extending axially there through, the tubular having a ball seat;

a ball positioned proximate the ball seat, the ball configured to move from a first position engaged with the ball seat to a second position disengaged from the ball seat to equalize pressure across a safety valve; and an arced ring positioned radially outside the ball and arced at least partially around the tubular, the arced ring configured to keep the ball engaged with the ball seat when in the first position and maintain the ball radially outside the ball seat when in the second position.

2. The equalizing device as recited in claim 1, further including an outer housing substantially surrounding the arced ring.

3. The equalizing device as recited in claim 2, wherein the outer housing is a ported retainer ring.

4. The equalizing device as recited in claim 3, wherein the ported retainer ring includes one or more fluid filters.

5. The equalizing device as recited in claim 1, wherein the arced ring has a first end located proximate the ball, and a second end physically attached to an outer surface of the tubular.

6. The equalizing device as recited in claim 5, wherein the first end of the arced ring includes chamfers for engaging the ball, and wherein the second end of the arced ring is physically attached to the outer surface of the tubular by a pin.

7. The equalizing device as recited in claim 1, wherein the ball integrally forms part of a first end of the arced ring.

8. The equalizing device as recited in claim 7, wherein the ball is a first ball and the arced ring further includes a second ball that integrally forms a part of a second end of the arced ring.

9. The equalizing device as recited in claim 1, further comprising a garter compression spring positioned radially about the arced ring.

10. The equalizing device as recited in claim 1, further including a ramp member positioned radially inside of the ball, the ramp member configured to move the ball from the first position to the second position as the ramp member moves axially along the tubular.

11. A safety valve for use within a wellbore, comprising:

a housing;

a flow tube extending axially through the housing, the flow tube configured to convey subsurface production fluids there through;

a valve closure mechanism disposed proximate a downhole end of the flow tube;

an equalizing device configured to equalize pressure across the valve closure mechanism, the equalizing device proximate to the valve closure mechanism, the equalizing device including:

a tubular having a central bore extending axially there through, the tubular having a ball seat;

a ball positioned proximate the ball seat, the ball configured to move from a first position engaged with the ball seat to a second position disengaged from the ball seat to equalize pressure across the safety valve; and an arced ring positioned radially outside the ball and arced at least partially around the tubular, the arced ring configured to keep the ball engaged with the ball seat when in the first position and maintain the ball radially outside the ball seat when in the second position; and an actuator associated with the housing, the actuator configured to axially slide the flow tube to move the valve closure mechanism between a closed state and an open state after the equalizing device has equalized the pressure.

12. The safety valve as recited in claim 11, further including an outer housing substantially surrounding the arced ring.

13. The safety valve as recited in claim 12, wherein the outer housing is a ported retainer ring.

14. The safety valve as recited in claim 13, wherein the ported retainer ring includes one or more fluid filters.

15. The safety valve as recited in claim 11, wherein the arced ring has a first end located proximate the ball, and a second end physically attached to an outer surface of the tubular.

16. The safety valve as recited in claim 15, wherein the first end of the arced ring includes chamfers for engaging the ball, and wherein the second end of the arced ring is physically attached to the outer surface of the tubular by a pin.

17. The safety valve as recited in claim 11, wherein the ball integrally forms part of a first end of the arced ring.

18. The safety valve as recited in claim 17, wherein the ball is a first ball and the arced ring further includes a second ball that integrally forms a part of a second end of the arced ring.

19. The safety valve as recited in claim 11, further comprising a garter compression spring positioned radially about the arced ring.

20. The safety valve as recited in claim 11, wherein the flow tube includes a ramp member near the distal end thereof and positioned radially inside of the ball, the ramp member configured to move the ball from the first position to the second position as the ramp member moves axially along the tubular.

21. A method for equalizing pressure across a valve closure mechanism of a safety valve, the method comprising:

placing a safety valve within a wellbore, the safety valve including;

a housing;

a flow tube extending axially through the housing, the flow tube having a ramp member on an outer surface thereof and configured to convey subsurface production fluids there through;

a valve closure mechanism disposed proximate a downhole end of the flow tube;

an equalizing device configured to equalize pressure across the valve closure mechanism, the equalizing device proximate to the valve closure mechanism, the equalizing device including:

a tubular having a central bore extending axially there through, the tubular having a ball seat;

a ball positioned proximate the ball seat, the ball configured to move from a first position engaged with the ball seat to a second position disengaged from the ball seat to equalize pressure across the safety valve; and an arced ring positioned radially outside the ball, the arced ring configured to keep the ball engaged with the ball seat when in the first position and maintain the ball radially outside the ball seat when in the second position; and an actuator associated with the housing and coupled to the flow tube; and powering the actuator to axially move the flow tube along the tubular, such that the ramp member moves the ball from the first position to the second position to substantially equalize pressure across the valve closure mechanism.

* * * * *